United States Patent [19]

Kling et al.

[11] Patent Number: 4,646,049

[45] Date of Patent: Feb. 24, 1987

[54] GLOW DISCHARGE STARTER CONTAINING THORIUM FOR IMPROVING DARK STARTING

[75] Inventors: Michael R. Kling; John W. Shaffer, both of Williamsport, Pa.

[73] Assignee: GTE Products Corporation, Stamford, Conn.

[21] Appl. No.: 799,880

[22] Filed: Nov. 20, 1985

[51] Int. Cl.[4] ..... H01H 61/00

[52] U.S. Cl. ..... 337/27; 337/22

[58] Field of Search ..... 337/27, 25, 24, 22; 315/73; 313/619

[56] References Cited

U.S. PATENT DOCUMENTS

| | | | |
|---|---|---|---|
| 2,324,907 | 7/1943 | Clack | 337/22 |
| 2,332,809 | 10/1943 | Peters | 337/26 |
| 2,376,669 | 5/1945 | Toro | 337/27 |
| 2,740,861 | 4/1956 | Lake | 337/27 |
| 2,930,872 | 3/1960 | Lake | 337/27 |
| 2,930,873 | 3/1960 | Lake et al. | 337/27 |

FOREIGN PATENT DOCUMENTS

| | | | |
|---|---|---|---|
| 3320933 | 12/1983 | Fed. Rep. of Germany . | |
| 618813 | 2/1949 | United Kingdom | 337/22 |

*Primary Examiner*—Harold Broome

*Attorney, Agent, or Firm*—Carlo S. Bessone

[57] ABSTRACT

A glow discharge starter having an hermetically sealed envelope containing an ionizable medium, a bimetallic electrode and a counter electrode located therewithin. A pair of lead-in conductors passes through one end of the envelope for electrically connecting the electrodes. A spot of dried paste is disposed on a surface within the envelope and comprises a mixture of thorium and a binder. The quantity of thorium is sufficient to reduce the dark effect of the glow discharge starter by improving the dark starting performance of the glow discharge starter.

17 Claims, 1 Drawing Figure

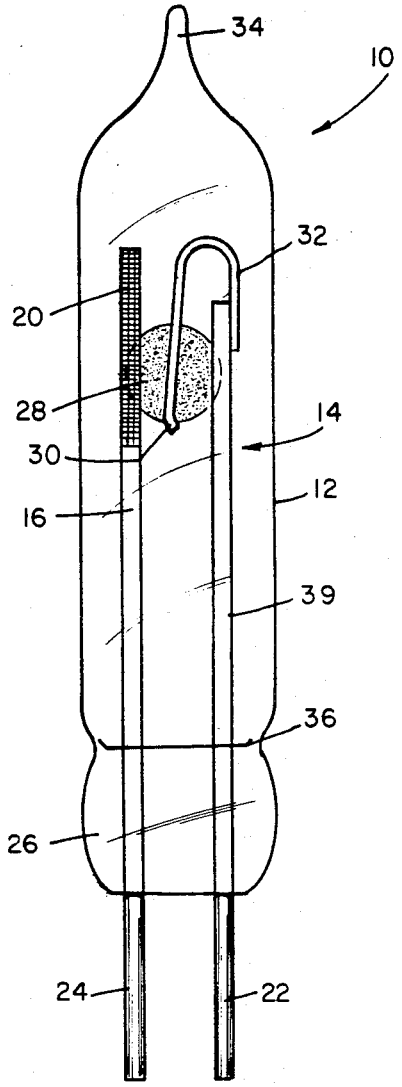
34
10
32
20
28
14
30
12
16
39
36
26
24
22

GLOW DISCHARGE STARTER CONTAINING THORIUM FOR IMPROVING DARK STARTING

TECHNICAL FIELD

This invention relates in general to glow discharge starters for arc discharge lamps and more particularly to glow discharge starters containing thorium for improving dark starting.

BACKGROUND OF THE INVENTION

A glow discharge starter is usually connected across or in parallel with an arc discharge lamp and contains a pair of electrodes. At least one of the electrodes comprises a bimetallic element which, when heated as a result of the glow discharge, bends towards the other electrode. When contact is made, the glow discharge ceases causing the bimetallic element to cool and withdraw from the contacted electrode. When contact is broken, a voltage pulse induced by the induction of the ballast, appears across the opposed electrodes of the lamp thereby initiating an arc discharge within the lamp. If the lamp ignition does not occur after the first voltage pulse, the glow discharge starter sequence is repeated until lamp ignition occurs.

A glow discharge starter of the aforementioned type is described, for example, in the book "Light Sources" by Elenbaas, Philips Technical Library, pages 102–103.

Glow discharge starters are subject to an effect commonly known as dark effect, whereby the breakdown voltage of the glow discharge in the starter is higher in the dark than in the light after a period of non-operation. The above-mentioned effect results in delay at starting and erratic operation. It is known that dark effect may be minimized or completely eliminated by including a radioactive material in the glow discharge starter envelope.

Several methods are known for reducing the dark effect in glow discharge starters. For example, U.S. Pat. No. 2,332,809, which issued to Peters on Oct. 26, 1943, discloses the use of a coating of a conductive material such as aluminum paint on the inner end of the stem and extending onto the lead-in wires at the points where they emerge from the press. Employing a coating of uranium oxide on the inner surface of the end wall of the glass envelope is described in U.S. Pat. No. 2,324,907, which issued to Clark on July 20, 1943 and U.S. Pat. No. 2,740,861, which issued to Lake on Apr. 3, 1956. A still further attempt of U.S. Pat. No. 2,930,872, which issued to Lake on Mar. 29, 1960 teaches the introduction of a minute quality of radioactive krypton 85 in addition to an impurity gas such as hydrogen, carbon dioxide or nitrogen. U.S. Pat. No. 2,930,873, which issued to Lake et al on Mar. 29, 1960, suggests introducing tritium and a carrier gas consisting of hydrogen into the gaseous filling of the glow discharge starter. Disadvantages of the above attempts to neutralize the dark effect include, for instance, substantial increases in material and/or manufacturing costs, severe material licensing requirements in the case of the krypton 85 or the effectiveness of the dark effect expedient decreases during the life of the glow discharge starter, thereby rendering the operation of the starter erratic and terminating its useful life.

Many commercially available glow discharge starters contain a getter holder centrally located at the end of the starter envelope remote from the stem press. The getter holder consists of a small piece of metal in which a cup is formed therein. The cup contains a getter mixture which, for example, may comprise barium, magnesium and a small amount of thorium. During fabrication and processing, the getter mixture contained within the cup of the getter holder is "flashed" onto the internal surface of the envelope and internal parts of the glow discharge starter.

Thorium is known as a radiation source effective in reducing the dark effect of glow discharge starters. The approach of introducing thorium into the glow discharge starter by means of a getter holder is expensive due to the relatively high cost of the getter holders and the equipment necessary for flashing.

SUMMARY OF THE INVENTION

It is, therefore, an object of the invention to obviate the disadvantages of the prior art.

It is another object of the invention to provide an alternative means for reducing the dark effect of glow discharge starters.

It is still another object of the invention to provide a less expensive means of introducing thorium into glow discharge starters.

These objects are accomplished, in one aspect of the invention, by the provision of a glow discharge starter comprising an hermetically sealed envelope containing an ionizable medium, a bimetallic electrode and a counter electrode within the envelope. A pair of lead-in conductors pass through one end of the envelope for electrically connecting the electrodes. A spot of paste is applied on a surface within the envelope and comprises a mixture of thorium and a binder. The quantity of thorium is sufficient to reduce the dark effect by improving the dark starting performance of the glow discharge starter. In accordance with one embodiment of the invention, the spot of paste is applied to a centrally located portion of the internal wall of the envelope.

In another aspect of the invention, a method for fabricating a glow discharge starter includes the steps of providing an envelope, preparing a paste comprising a mixture thorium powder, a binder and a solvent and applying a spot of the paste on a surface within the envelope. A bimetallic electrode and a counter electrode is formed and sealed within one end of the envelope and the spot of paste is dried. The envelope is exhausted, an ionizable medium is dispensed therewithin and the envelope is hermetically sealed.

BRIEF DESCRIPTION OF THE DRAWING

The sole FIGURE is a front elevational view of an embodiment of a glow discharge starter according to the invention.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Referring now to the drawing with greater particularity, there is shown in the sole FIGURE a glow discharge starter 10 comprising a sealed envelope 12 containing an ionizable medium. The ionizable medium may comprise helium and argon or mixture thereof. A bimetallic electrode 14 and a counter electrode 16 are located within envelope 12. Electrodes 14 and 16 are electrically connected to or formed from lead-in conductors 22 and 24, respectively. Bimetallic electrode 14 comprises a post 39 which is electrically connected to or formed from lead-in conductor 22 and a bimetallic element 32. Preferably, post 39, counter electrode 16 and lead-in conductors 22 and 24 are formed of a nickel-iron alloy coated with a layer of copper, such as Dumet, plated with an electrically conductive material, e.g., nickel. Bimetallic element 32 which is bent over into a U-shape, as shown in the sole FIGURE, so that the free end 30 thereof is proximate to counter electrode 16. Bimetallic element 32 consists of two strips of metal having different linear coefficients of expansion welded together. The side of higher coefficient of expansion is on the inside curve of the U so that bimetallic element 32 opens out and engages counter electrode 16. The free end 30 of bimetallic element 32 may be provided with an outwardly projecting embossment or curved portion (not shown) to insure that contact with counter electrode 16 is always made at the same point after flexure of bimetallic element 32 through a predetermined distance.

Counter electrode 16 can be constructed as a second bimetallic electrode (i.e., comprise a post and bimetallic element) as shown, for example, in previously mentioned U.S. Pat. No. 2,930,873.

A section 20 of counter electrode 16 adjacent bimetallic element 32 is coated with a mixture of low work function metals, such as lanthanum-nickel, to lower the breakdown voltage of glow discharge starter 10.

In accordance with the invention, a spot of dried paste comprising a mixture of thorium and binder is disposed on a surface within the envelope. In a preferred embodiment as shown in the sole FIGURE, the spot of dried paste 28 is disposed on a portion of the internal wall of envelope 12 of glow discharge starter 10. It is possible for the dried paste to be located on a surface within envelope 12 other than on the internal wall of the envelope. For example, the spot of dried paste may be coated on the counter or bimetallic electrodes. Also, the spot of dried paste may take a form other than a round dot as shown in the sole FIGURE.

The spot is applied as a paste comprising thorium powder and a suitable binder such as polystyrene or a styrene-butadiene copolymer. The thorium and binder are mixed into a solvent such as xylene or toluene. To decrease thorium settling, hydrophobic fumed silica can be added. The exact composition of the thorium paste is not critical as long as the binder, resin and solvent system is compatible with and nonreactive toward the thorium powder. For best results, the resin and solvent is pH neutral, anhydrous and free of reactive groups such as hydroxyl or amines. Halogenated solvents are not recommended because of a possible explosive reaction with the thorium. For best results, the paste is milled on a ball mill for approximately 20 hours. Milling reduces the particle size of the thorium and greatly enhances its retention in suspended form.

As to the manufacture of the above-described glow discharge starter, a suitable envelope is provided. A paste comprising a mixture of thorium powder, a binder and a solvent is prepared. A spot of the paste is applied on a surface within the envelope. A pair of electrodes are formed and include a bimetallic electrode and a counter electrode. The bimetallic electrode and the counter electrode are sealed within one end of the envelope and the spot of paste is dried. The envelope is finally exhausted and an ionizable medium is dispensed therein. The envelope is hermetically sealed by pinching off. Thus, a glow discharge starter having an operational capability is provided.

According to one specific implementation of a glow starter switch according to the invention, envelope 12 is formed from lead glass having an outside diameter of 0.175 inch (4.445 millimeters), a wall thickness of 0.016 inch (0.406 millimeter) and an overall length of 0.8 inch (20 millimeters). Lead-in wires 22 and 24, which extend through the press 26 and form counter electrode 16 and post 39 of bimetallic electrode 14, are made of nickel plated dumet. Lead-in wires 22 and 24 are separated by 0.060 inch (1.524 millimeters). One end 38 of bimetallic element 32 is welded to post 39. The other free end 30 of bimetallic element 32 is spaced a distance of 0.025 inch (0.635 millimeter) from counter electrode 16.

A paste, which provides particularly satisfactory results, has the following composition: 0.20 gram of hydrophobic fumed silica, 0.30 gram of polystyrene resin, 4.5 grams of mixed xylenes and 9.5 grams of 200-mesh thorium powder. A binder is first made with the silica, polystyrene resin and xylene. The thorium powder is then stirred into the binder.

A spot of the foregoing paste is applied to a portion of the internal wall of the envelope according to a specific embodiment as illustrated in the accompanying drawing. The spot is centrally located within the envelope so that it is spaced equidistant between the tip 34 and the top portion 36 of press 26 of glow discharger starter 10.

In one example made in accordance with the invention, a spot of the foregoing thorium-containing paste having a dry weight of 0.4 milligram was applied on the internal wall of the envelope. In a second example, 0.8 milligram (dry weight) was applied. In both examples the center of the spot was located approximately 0.33 inch (8.382 millimeters) from the tip of the envelope so that the spot ended up at about the center of the glow discharge starter. After applying the paste by hand to the internal wall of the envelope, the starters were processed in the normal manner. The heat during processing is sufficient to dry the thorium-containing paste. The samples were filled with a gaseous mixture of 25 percent helium and 75 percent argon at a pressure of 18 torr.

Testing was accomplished by sealing the glow discharge starters in black PVC tubing. After a 24 hour period of non-operation, 106 volts, 60 cycles were applied to the starter while monitoring the current. The bimetallic element should contact the counter electrode within approximately 10 seconds, if the glow discharge starter is functioning properly. The effect of the spot coating of thorium on the dark effect as it applies to starting is shown in Table I.

TABLE I

| Glow Discharge Starter | Dark Start Within 10 Seconds |
|---|---|
| Control-no thorium spot | 12 out of 27 (44%) |
| 0.4 milligram thorium spot | 8 out of 9 (89%) |
| 0.8 milligram thorium spot | 32 out of 33 (97%) |

Table I above shows the improvement in dark starting performance between glow discharge starters made with and without the thorium spot. Significant results can be obtained by using 0.1 milligram to 1.0 milligram dry weight of the thorium paste which is equivalent to approximately 0.095 milligram to 0.95 milligram of thorium.

While there have been shown and described what are at present considered to be the preferred embodiments of the invention, it will be apparent to those skilled in the art that various changes and modifications can be made herein without departing from the scope of the invention as defined by the appended claims.

We claim:

1. A glow discharge starter comprising an hermetically sealed envelope containing an ionizable medium, a bimetallic electrode and a counter electrode located within said envelope, a pair of lead-in conductors passing through one end of said envelope for electrically connecting said electrodes, and a spot of dried paste disposed on a surface within said envelope, said dried paste comprising a mixture of thorium, hydrophobic fumed silica and a binder, the quantity of said thorium being sufficient to reduce the dark effect by improving the dark starting performance of said glow discharge starter.

2. The glow discharge starter of claim 1 wherein said spot of dried paste is disposed on a portion of the internal wall of said envelope.

3. The glow discharge starter of claim 2 wherein said spot of dried paste is centrally located within said envelope.

4. The glow discharge starter of claim 1 wherein said ionizable medium comprises a mixture of helium and argon.

5. The glow discharge starter of claim 4 wherein said ionizable medium comprises a mixture of 25% helium and 75% argon.

6. The glow discharge starter of claim 1 wherein said bimetallic electrode comprises a post and a bimetallic element secured to said post.

7. The glow discharge starter of claim 6 wherein said post of said bimetallic electrode, said counter electrode and said lead-in conductors are formed of a nickel-iron alloy coated with a layer of copper.

8. The glow discharge starter of claim 7 wherein said lead-in conductors are plated with an electrically conductive material.

9. The glow discharge starter of claim 8 wherein said electrically conductive material is nickel.

10. The glow discharge starter of claim 1 wherein a portion of one of said electrodes is coated with a lanthanum-nickel alloy.

11. The glow discharge starter of claim 10 wherein a portion of said counter electrode is coated with a lanthanum-nickel alloy.

12. The glow discharge starter of claim 1 wherein said envelope is formed of lead glass.

13. The glow discharge starter of claim 1 wherein said binder is polystyrene resin.

14. The glow discharge starter of claim 1 wherein said binder is a styrene-butadiene copolymer.

15. The method of making a glow discharge starter comprising the steps of:

providing an envelope;

preparing a paste comprising a mixture of thorium powder, hydrophobic fumed silica, a binder and a solvent;

applying a spot of said paste on a surface within said envelope;

forming a bimetallic electrode and a counter electrode;

sealing said bimetallic electrode and said counter electrode within one end of said envelope and drying said spot of said paste;

exhausting said envelope;

dispensing an ionizable medium into said envelope; and hermetically sealing said envelope.

16. The method of claim 15 wherein said binder is polystyrene resin.

17. The method of claim 15 wherein said binder is a styrene-butadiene copolymer.

* * * * *